United States Patent [19]

Tomimasu et al.

[11] Patent Number: 4,631,743

[45] Date of Patent: Dec. 23, 1986

[54] X-RAY GENERATING APPARATUS

[75] Inventors: Takio Tomimasu, Yatabemachi; Tsutomu Noguchi, Kukisakimachi; Hiroshi Tanino, Sakuramura; Suguru Sugiyama, Ishioka, all of Japan

[73] Assignees: Agency of Industrial Science & Technology; Ministry of International Trade & Industry, both of Tokyo, Japan

[21] Appl. No.: 653,588

[22] Filed: Sep. 24, 1984

[30] Foreign Application Priority Data

Sep. 22, 1983 [JP] Japan ..... 58-175517
Sep. 27, 1983 [JP] Japan ..... 58-178984

[51] Int. Cl.[4] ..... H05H 13/04

[52] U.S. Cl. ..... 378/138; 328/233; 328/235; 378/119

[58] Field of Search ..... 378/138; 328/233, 235

[56] References Cited

U.S. PATENT DOCUMENTS 3,344,357 9/1967 Blewett ..... 328/235
3,986,026 10/1976 Martin ..... 328/235
4,392,080 7/1983 Maschke ..... 328/233

OTHER PUBLICATIONS

*Physical Review Letters*, vol. 36, No. 13, Mar. 29, 1976, pp. 717–720, Elias, Luis R. et al., "Observation of Stimulated Emission of Radiation by Relativistic Electrons in a Spatially Periodic Transverse Magnetic Field".

*Primary Examiner*—Craig E. Church
*Assistant Examiner*—David P. Porta
*Attorney, Agent, or Firm*—Oblon, Fisher, Spivak, McClelland, & Maier

[57] ABSTRACT

An X-ray generating apparatus provided with at least one deflecting means disposed between a freely selected pair of adjacent deflecting electromagnets and adapted to undulate electrons around a design orbit. When the deflecting means if formed of variable horizontally or vertically deflecting electromagnets capable of forming a variable magnetic field for electron on the orbit, the electrons are undulated around the design orbit and synchrotron radiation or powerful wiggler radiation from a wiggler is generated to irradiate a large area of a given substrate. Thus, in the transfer of patterns for the production of LSI devices for example, the X-ray generating apparatus enables highly intensive X-rays abundantly containing soft X-rays to be emitted uniformly to irradiate a wide area.

10 Claims, 23 Drawing Figures

X-RAY GENERATING APPARATUS

BACKGROUND OF THE INVENTION

1. Field of the Invention

This invention relates to an X-ray generating apparatus which uses synchrotron radiation (SR) and is advantageously applicable to soft X-ray lithography, for example. More particularly, this invention relates to an X-ray generating apparatus which, by means of an electron undulating ring capable of accumulating electrons as accelerated in an orbit, enables high-intensity X-rays abounding with soft X-rays suitable for fine processing such as transfer of LSI circuit patterns to be generated with high efficiency in a manner suitable for irradiation of a large area 2. Description of the Prior Art Heretofore, in the production of LSI devices of fine structure, the technique of photolithography has been adopted for the transfer of patterns to resist films.

Owing to light diffraction, the minimum pattern width that can be transferred by photolithography is about 1 μm, a size substantially equal to the wavelength of light. For further reduction of the pattern width, there has been increasingly felt a necessity for a lithographic technique capable of mass transfer of patterns on the submicron order. The technique of X-ray lithography which entails minimal diffraction constitutes one such technique.

As the X-ray source for this technique, an attempt has been made to realize adoption of characteristic X-rays obtainable by bombarding a solid target with an electron beam. The wavelength of an X-ray is inversely proportional to its energy. An X-ray of short wavelength has high energy. In most cases, the X-ray has too high energy to interact strongly with the electrons in a given substance. It simply penetrates the substance without being affected by any local variation in the arrangement of atoms in the substance. In the transfer of a pattern onto a resist film, therefore, the X-ray is absorbed by the resist with poor efficiency and is required to irradiate the resist for a long time. To ensure sufficient mask contrast, the film absorbing the X-ray is required to have a very large thickness. Because of the short wavelength, the photoelectrons generated in the resist film and the substrate have so high energy as to induce diffusion of secondary photoelectrons and degradation of resolving power. To preclude the effects of penumbra and geographic distorsion, an ample distance must be interposed between the X-ray source and the wafer. Since the X-ray source of this type is of a divergent type, the utilization efficiency of the beam decreases in inverse proportion to the square of the distance. To obtain a beam strength that is sufficient from the practical point of view, the X-ray source to be adopted is required to possess very high intensity. Realization of an X-ray source satisfying all these requirements proves infeasible by the existing technical standard.

To solve the problems described above, the soft X-rays of rather long wavelength which are emitted quite abundantly from a synchrotron electron accelerator such as an electron storage ring has come to find acceptance. The lithography making use of the soft X-rays attains density in the transfer of a fine electron circuit pattern at least two orders of ten higher than the density obtainable by the existing method.

The soft X-rays emitted by the existing electron storage ring are such that the intensity and uniformity appropriate for the purpose of transfer of circuit patterns are obtained in a very narrow area on the order of several millimeters in vertical size. As measures for widening the tilt angle amply, there have been devised means of reciprocating the wafer, an article exposed to the X-rays, relative to the X-rays of synchrotron radiation thereby allowing the X-rays to irradiate the entire surface of the wafer uniformly and means of disposing a flat or curved reflecting mirror provided with a swinging mechanism in the path of the X-rays of synchrotron radiation thereby oscillating the X-rays of radiation either vertically or laterally and enabling the X-rays to irradiate the entire surface of the wafer.

When a wafer for the LSI device is lithographically fabricated by the former method which necessitates reciprocation of the wafer itself, however, the positioning of a mask turns out to be a difficult task. Thus, this method is not suitable for mass fabrication of LSIs. Further, it has a disadvantage that it inevitably entails mechanical error. The latter method which involves use of a reflecting mirror suffers from the following disadvantages.

The first disadvange is that since the available spectral intensity of the soft X-rays is variable with the reflectance of the material forming the mirror surface, the exposure time can be estimated only with difficulty. The second disadvantage is that since the reflectance of the mirror surface is gradually degraded by deposition of extraneous substances on the mirror surface due to the irradiation of light, this method requires periodic replacement of the mirror. It also requires the intensity of the soft X-rays to be confirmed each time the irradiation of the X-rays is effected. Further, the degradation of the reflectance does not necessarily proceed uniformly over the entire mirror surface, and the mirror surface, therefore, may cause uneven irradiation of the X-rays upon the wafer.

OBJECT OF THE INVENTION

An object of this invention is to provide an X-ray generating apparatus which starts electron undulation and induces highly efficient generation of high-intensity X-rays abundantly containing soft X-rays by means of an electron storage ring and, at the same time, increases the intensity and the tilt angle of the X-ray-containing radiation from the electron storage ring and effects irradiation of a large area uniformly and stably, and enables the oscillating incidence of the radiation upon the resist film to be carried out accurately and highly efficiently without relying upon any mechanical setup or entailing any physical error.

SUMMARY OF THE INVENTION

To accomplish the object described above, the X-ray generating apparatus of the present invention comprises a plurality of deflecting electromagnets disposed along an electron orbit, multipole electromagnetic devices disposed between freely selected adjacent deflecting electromagnets and adapted to focus electrons on the orbit in horizontal and vertical directions, and at least one variably deflecting means disposed within at least one of the multipole electromagnetic devices and adapted to undulate the electrons in the vertical and/or horizontal direction around a stable electron orbit (design orbit)

As the variably deflecting means to be disposed within one multipole electromagnetic mechanism formed of freely selected singlet, doublet, or triplet focusing electromagnet and used for deflecting an electron orbit, there is used a variable vertically deflecting electromagnet and/or a variable horizontally deflecting electromagnet.

By controlling the magnitude of the electric current fed to the variable vertically and/or horizontally polarizing electromagnet, the tilt angle of the synchrotron radiation and the position of the light source can be suitably varied in proportion to the change of magnetic field components. By this arrangement, the apparatus of this invention is enabled to provide stable irradiation of a large area with a high-intensity radiation abundantly containing soft X-rays. Further, in accordance with this invention, the X-ray radiation abounding with soft X-rays can be advantageously utilized for X-ray lithography in fine fabrication of LSI devices and for X-ray microscopy. Since the apparatus effects the required irradiation without recourse to any mechanical oscillation, it can be controlled easily and operated with notably high accuracy.

The other objects and characteristics of the present invention will become apparent from the further disclosure of the invention to be made in the following detailed description of preferred embodiments, with reference to the accompanying drawings.

BRIEF DESCRIPTION OF THE DRAWINGS

FIG. 2(*b*) is a model diagram of synchrotron radiation emitted from the electron orbit in a magnetic field in the vertical direction.

FIG. 5(*b*) is a model diagram illustrating the condition of undulation produced in the apparatus of FIG. 5(*a*).

FIG. 9(*b*) is a schematic side view of the deflecting electromagnet.

FIG. 13(*b*) is an explanatory diagram illustrating the directivity of the radiation SR.

FIG. 13(*c*) is an explanatory diagram illustrating the directivity of the radiation WR.

DESCRIPTION OF THE PREFERRED EMBODIMENTS

Figure 1:
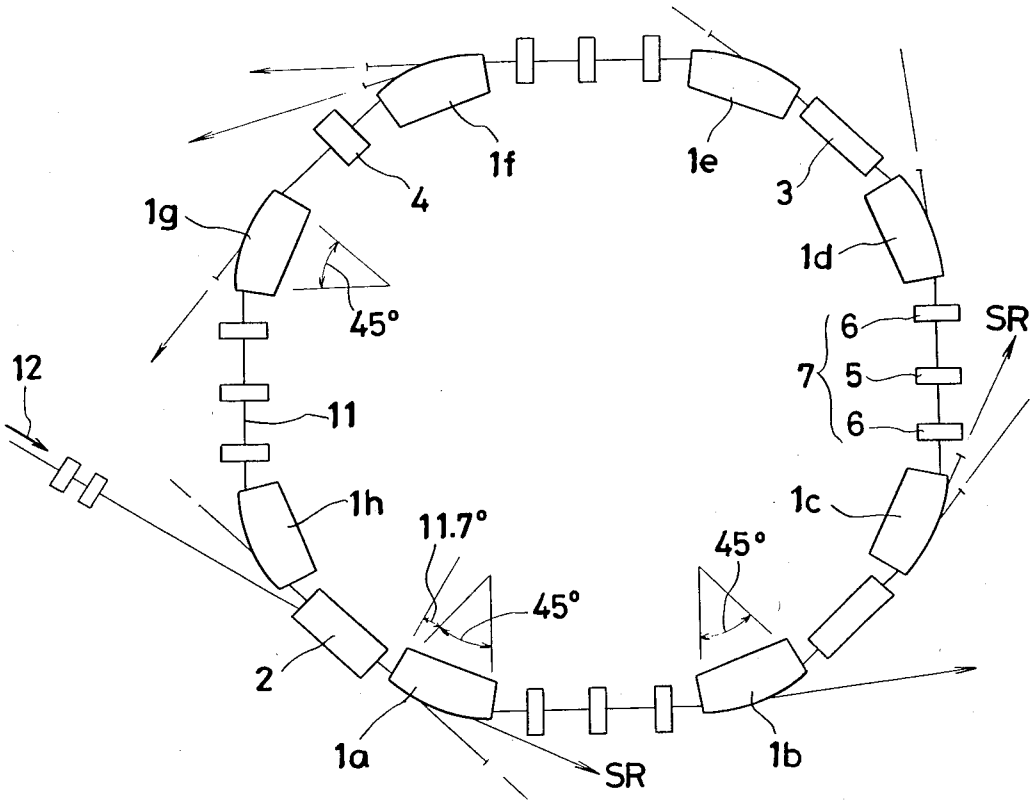
FIG. 1 (Prior Art)
FIG. 1 is a schematic structural diagram of an electron storage ring serving as a conventional X-ray generating apparatus.

FIG. 1 schematically illustrates a conventional X-ray generating apparatus which issues X-rays, particularly X-rays of rather long wavelength, from an electron storage ring adapted to accelerate electrons along an orbit within a magnetic field and accumulate the accelerated electrons.

In the diagram 1*a*–1*h* denote deflecting electromagnets, 2 denotes a septum electromagnet for incidence, 3 a kicker coil for correction of the electron orbit, 4 a high-frequency cavity for acceleration of electrons and 7 a triplet formed of a quadrupole electromagnet 5 possessing focusing power in the vertical direction (hereinafter referred to as "Qd" for short) and quadrupole electromagnets 6 possessing focusing power in the horizontal direction (hereinafter referred to as "Qf") and disposed one each on the opposite sides of the Qd.

By way of example, an electron storage ring wherein the orbit has a radius of 2 meters and deflecting magnets 1*a*–1*h* have a deflection angle of 45° will be described. An electron beam which impinges upon the septum electromagnet 2 for incidence passes through a minute rectangular entrance 8 mm×10 mm and runs in parallel to the stable electron orbit (design orbit) 11 at a distance of 40 mm outwardly from the design orbit. While the incident electrons 12 revolve along the electron orbit 11 several times, they are scattered away on collision against a partition panel bordering on the septum electromagnet 2 for incidence. Thus, the electron beam 11 is corrected by feeding a very short pulse current synchronized with the electron beam to the kicker coil 3 disposed one half cycle downstream. Consequently, the electrons 12 are accelerated and accumulated by the high-frequency cavity 4 disposed one quarter cycle further downstream and the electron energy is proportionally increased.

The synchrotron radiation (SR) is the electromagnetic wave which is released when the electron orbit 11 is bent by a deflecting magnet.

The radiation SR is a divergent light source which possesses sharp directivity only in the direction perpendicular to the plane of the electron orbit 11 and issues a diverging light in the direction tangential to the circular electron orbit 11. Because of its narrow tilt angle, the radiation SR cannot be safely used as an intensifier light source having a wide tilt angle necessary for the technique of lithography. It further has a disadvantage that it is incapable of utilizing the electron beam as stably moved at a constant rate in the vertical and horizontal directions relative to the design orbit.

Figure 2A:
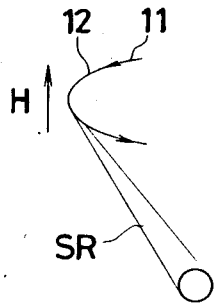
FIG. 2(*a*) is a model diagram of synchrotron radiation emitted from a point of the electron orbit in a magnetic field.
Figure 2B:
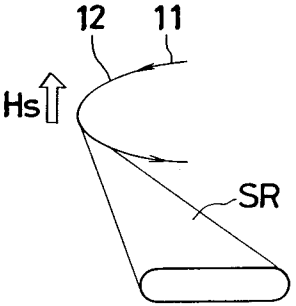

This point will be described in further detail below. When the electron beam has its orbit bent in a magnetic field H as illustrated in FIG. 2(*a*), the synchrotron radiation SR is diverged in the direction of emission in the form of a cone having a circular cross section. When the electron beam is bent in a static magnetic field Hs in the vertical direction as illustrated in FIG. 2(*b*), because of the superimposition of the points of light emission on the electron orbit 11, the radiation is diverged uniformly in the lateral direction (the direction falling in the plane of orbit) and with a small increase of angle in the vertical direction (the direction perpendicular to the plane of orbit). Thus, the electron beam can be focused wholly and utilized for the irradiation of the surface of the wafer for the fabrication of an LSI device, for example, with no part of the beam wasted.

Figure 3:
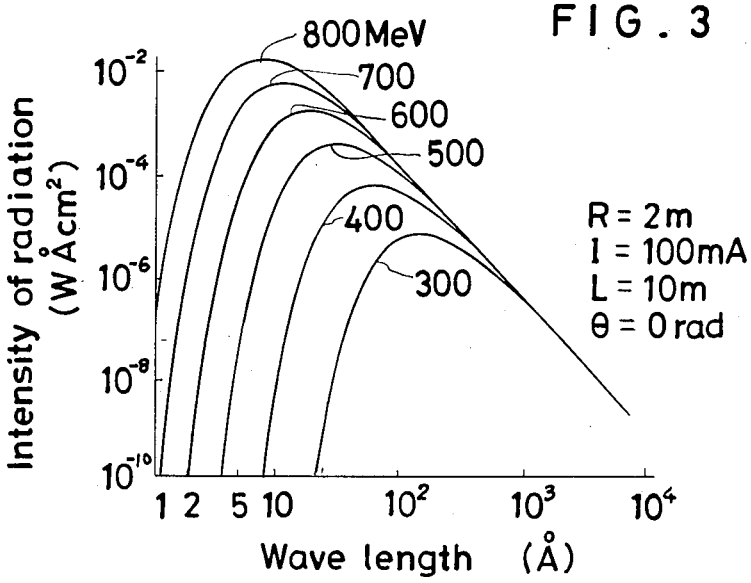
FIG. 3 is a characteristic diagram showing the distribution of intensity of radiation emitted from the electron storage ring relative to wavelength.

The synchrotron radiation SR has a continuous spectrum ranging from X-ray component through microwave component as illustrated in FIG. 3. By selecting the kinetic energy of the electrons 12, however, a beam which contains X-rays of short wavelength only sparingly and consists preponderantly of soft X-rays of 10 Å to 100 Å befitting the purpose of lithography can be obtained.

The data on intensity of radiation versus wavelength obtained under the conditions of radius of orbit, R=2 m, amount of current, I=100 mA, distance between the point of light emission and the wafer, L=10 m, and tilt angle from the plane of orbit, $\theta=0$ rad, are shown in FIG. 3.

As described above, the intensity of the synchrotron radiation SR which can be utilized for irradiation of the wafer surface is very high and enables transfer of pattern to be effected with a very short exposure time.

To make the most of this high intensity of radiation, the distance between the point of light emission and the wafer is desired to be fully reduced within the range in which the penumbra and the geometric distorsion are incapable of manifesting their adverse effects. It is required to fall in the range of about 5 to 10 m. The angle of divergence of the electron beam in the vertical direction in this case, however, is too narrow for exposure of one LSI chip. When the distance between the point of light emission and the wafer is fixed at 10 m, for example, it is within the width of about 4 mm that the intensity of the soft X-ray component available for lithography is substantially uniformized This width cannot easily be increased by varying the energy of the electrons or the orbit radius To realize in the vertical direction a uniform area of exposure of a width of about 1 cm to 10 cm required for irradiation of one chip or one wafer, the path of the soft X-rays must be varied by some method or other.

For the alteration of the path, a few devices illustrated in FIGS. 4(*a*)-(*d*) have been proposed. These conventional devices will be described below as used in the irradiation of an LSI wafer 20.

(1) The device of FIG. 4(*a*) is adapted to effect the alteration of the path by moving the wafer 20 itself in the vertical direction.

(2) The device of FIG. 4(*b*) utilizes a flat mirror 21 adapted to reflect the synchrotron radiation SR and effects oscillation of the radiation in the vertical direction by shaking the flat mirror 21 at a suitable rate.

(3) The device of FIG. 4(*c*) reflects the synchrotron radiation SR with a convex mirror or concave mirror 22 so as to produce radiation of uniform intensity on a wide area.

(4) The device of FIG. 4(*d*) combines a plurality of flat mirrors or concave mirrors to enlarge the uniform deivergence of radiation in the vertical direction by sending back the unnecessary reflected beams falling outside the lateral edges of the wafer 20.

Of the devices indicated above, the device of (1) can be expected to encounter technical difficulties because it is required to possess the freedom of the mechanism of movement on top of the complexity of the mechanism of wafer aligner capable of superimposing a plurality of masks M as accurately registered upon the wafer 20 and processing a large number of wafers.

The devices of (2), (3) and (4) use mirrors 21-23. Thus, they have a common disadvantage that variation of reflectances renders estimation of exposure time difficult and accuracy of operation is degraded by deposition of extraneous substance due to irradiation or by mechanical factors.

The present invention is directed to solving the drawbacks suffered by the conventional methods for alteration of the path of radiation. The embodiment of this invention will be described below with reference to the accompanying drawings.

Figure 5B:
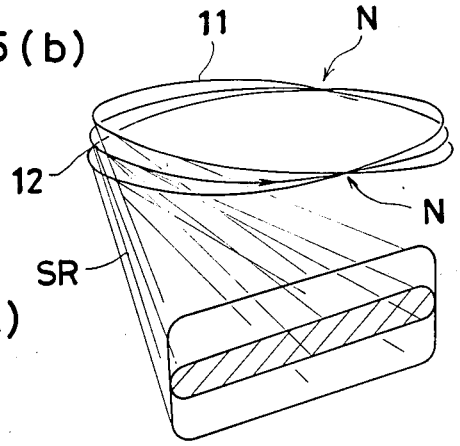
FIG. 5(*a*) is a model diagram of a typical X-ray generating apparatus as one embodiment of this invention.
Figure 5A:
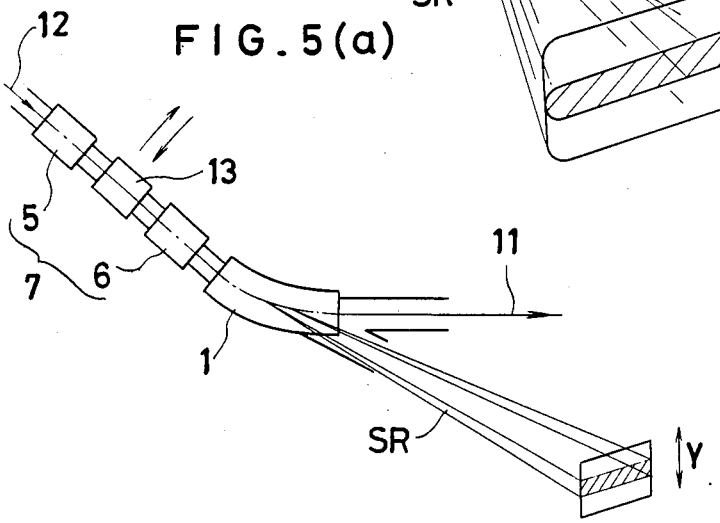
Figure 4A:
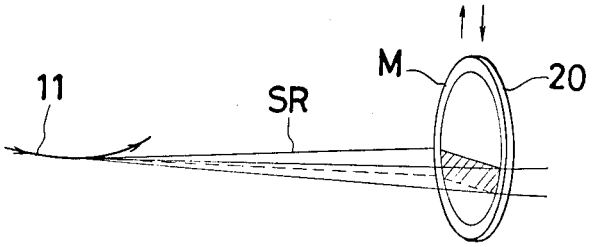
FIG. 4(a) (Prior Art)
FIGS. 4(*a*)–(*d*) are model diagrams of conventional apparatuses capable of uniform exposure in the vertical direction (the direction perpendicular to the plane of orbit).
Figure 4B:
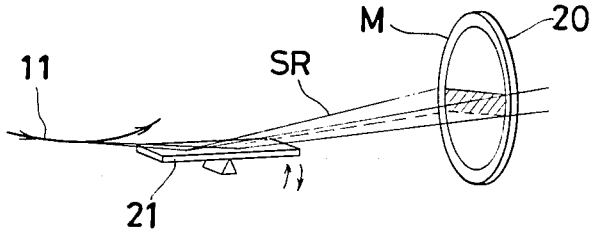
FIG. 4(b) (Prior Art)
Figure 4C:
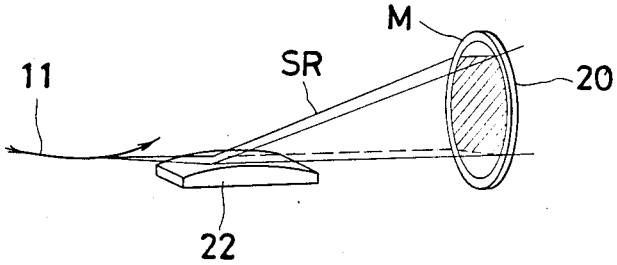
FIG. 4(c) (Prior Art)
Figure 4D:
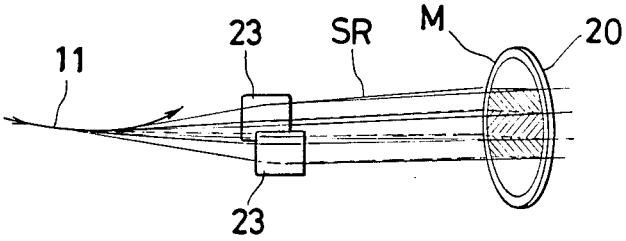
FIG. 4(d) (Prior Art)

FIG. 5(*a*) illustrates part of an electron storage ring (which, unlike the conventional countertype, is capable of undulating an electron beam and, therefore, will be referred to as "electron undulating ring" for distinction) constituting an X-ray generating apparatus as the first embodiment of this invention.

The electron undulating ring in the illustrated embodiment is provided with a multipole electromagnetic mechanism 7 which forms a doublet structure with a dipole electromagnet 1 for deflection disposed at a position for withdrawal of synchrotron radiation SR, a multipole electromagnet 6 for focusing the electron beam in the horizontal direction for stable revolution, and a multipole electromagnet 5 for focusing the electron beam in the vertical direction. As described afterward, this multipole electromagnetic mechanism 7 may be in the form of a singlet structure using just one multipole electromagnet for horizontal forcusing. It may be otherwise in the form of a triplet structure consisting of one multipole electromagnet for horizontal focusing and two multipole electromagnets for vertical focusing. Of course, such multipole electromagnetic structure may be in a modified form. Further, the multipole electromagnet may be an electromagnet provided with a quadrupole core or a coil type electromagnet.

In the ring of the basic structure described above, variable deflecting means 13 having a magnetic field component Hh in the lateral direction is inserted for alteration of the electron orbit in the multipole electromagnetic mechanism 7. In the present embodiment, the aforementioned variable deflecting means 13 is interposed between the electromagnet 5 for vertical focusing and the electromagnet 6 for horizontal focusing constituting the multipole electromagnetic mechanism 7 selected at one point in the ring. The variable deflecting means 13 may be of any structure so far as it is a magnetic means capable of generating a magnetic field of required intensity. It may be an electromagnet using an iron core or a coil type electromagnet.

In the arrangement described above, the direction of the electron beam vertically focused by the electromagnet 5 for vertical focusing is slightly deflected in the vertical direction relative to the design orbit owing to the lateral magnetic field component Hh of the variable deflecting electromagnet 13. This deflection is magnified by the electromagnet 6 for lateral focusing (converging in the lateral direction and diverging in the vertical direction) and, consequently, the undulating orbit of electrons within the electromagnet 1 for deflection is heavity disintegrated in the vertical direction (the direction Y). As a result, the synchrotron radiation SR containing the soft X-rays is undulated in the vertical direction on the wafer under treatment by irradiation. The condition of the undulation thus produced is as illustrated in the schematic diagram of FIG. 5(*b*). It is noted from this diagram that the undulating orbit of electrons produces a node N, namely a portion which always intersects the design orbit at one fixed position relative to the position at which the variable deflecting electromagnet is disposed (FIG. 5(*b*)).

Figure 6:
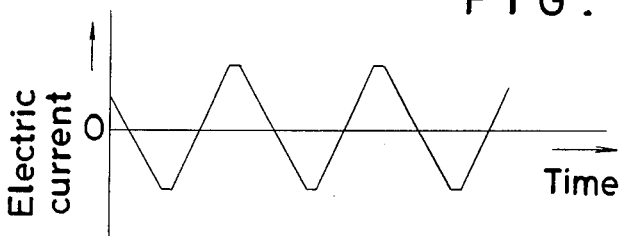
FIG. 6 is a diagram showing a typical waveform of the current fed to a variable electromagnet in the embodiment of FIG. 5.

When a current of 1A is fed to the variable deflecting electromagnet 13, for example, there is generated a lateral magnetic field of about 50 gausses. Consequently, the plane of orbit of electrons 12 is affected and caused to move by 13 mm at a distance of 10 m from the point of light emission By fluctuating this magnitude of current with triangular waves at a fixed rate (such as, for example, 0.3 sec) as illustrated in FIG. 6, uniform irradiation can be obtained on the substrate under treatment within a range of 3 cm of width in the vertical direction.

In accordance with the method described above, firstly the radiation can be obtained with very high uniformity because absolutely no optical device is used between the point of emission of the X-rays and the substrate under treatment, secondly the estimation and fixation of the required exposure time are easily effected because the synchrotron radiation SR possesses a smoothly continuing spectrum inherent to itself, and thirdly the control of the exposure time can be easily effected because the soft X-rays of a fixed amount of light is generated by a fixed electron current. Since the present embodiment is provided with the variable electromagnet for variable generation of magnetic field which scans the electron orbit in the vertical direction along the course of time, it enables the soft X-ray lithography to be carried out uniformly and stably with a high throughput by making the most of the outstanding characteristics inherent in the synchrotron radiation without any sacrifice.

In the embodiment described above, the variable deflecting electromagnet 13 is disposed immediately next to the electromagnet 5 for vertical focusing. This invention does not place any restriction on the location of the variable deflecting electromagnet 13. It may be disposed anywhere so long as it possesses a variable horizontal magnetic field component.

Figure 7:
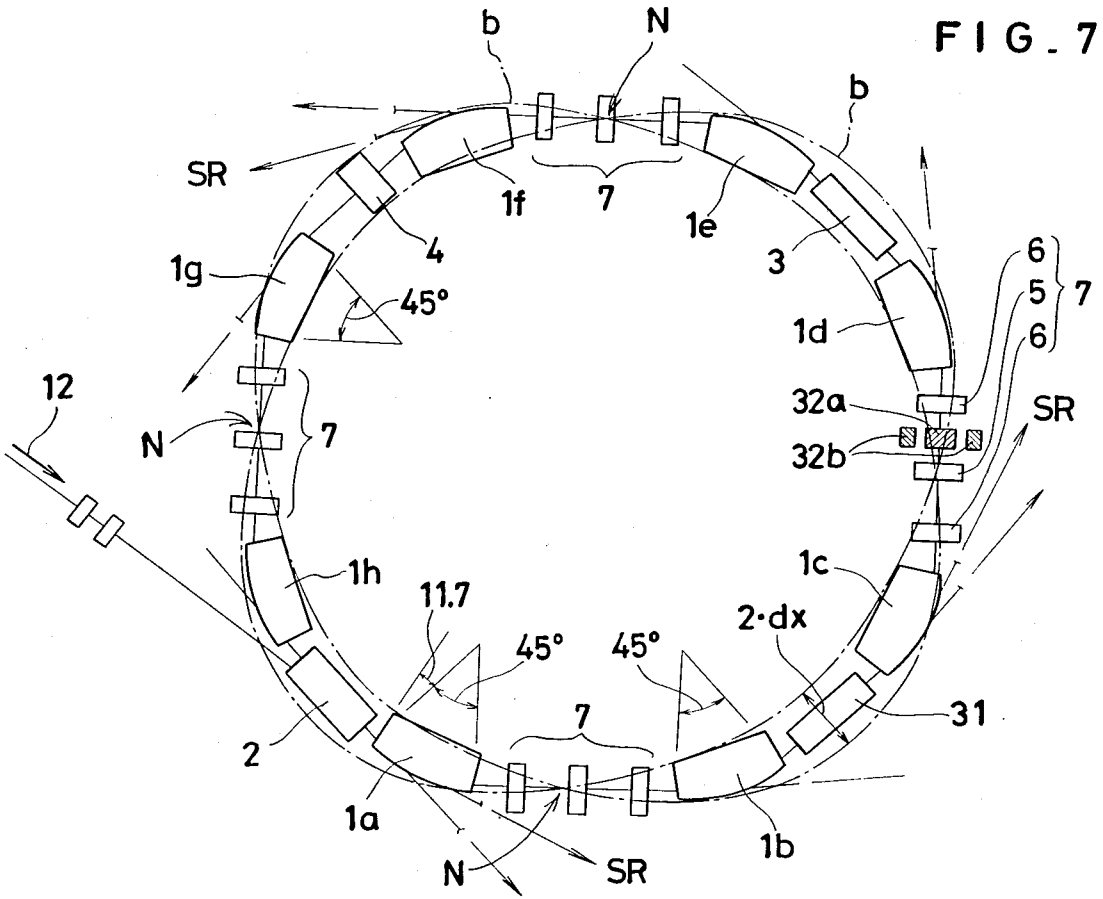
FIG. 7 is a schematic structural diagram of another typical X-ray generating apparatus embodying this invention.

In another embodiment illustrated in FIG. 7, the beam of charged particles can be undulated stably at a fixed velocity in the horizontal and vertical directions and, as a result, the tilt angle of the synchrotron radiation and the position of the light source can be varied and the radiation can be generated with high brightness. In the diagram, the same symbols as those found in the preceding embodiment denote equivalent components.

In FIG. 7, 31 denotes a wiggler which transforms a part of the energy of translated or deflected electrons into light. In this embodiment, the multipole electromagnetic mechanisms 7 are each in a triplet structure formed of one multipole electromagnet for focusing electrons in the vertical direction (hereinafter referred to as "Qd" for short) and two multipole electromagnets 6 for focusing electrons in the horizontal direction (hereinafter referred to as "Qf" for short). Within one of the multipole electromagnetic mechanisms 7, a variable vertically deflecting electromagnet 32*a* and a variable horizontally deflecting electromagnet 32*b* are disposed in such a manner as to encircle the electron orbit. Now, the deflection of the orbit of electron beam will be described below, first with respect to the deflection in the vertical direction and then with respect to the deflection in the horizontal direction.

In the electron undulating ring of the present invention, not only the synchrotron radiation (SR) issued when the electron orbit is bent by the deflecting electromagnet but also the intense radiation derived from the aforementioned wiggler (wiggler radiation, WR) can be utilized to advantage. Here and in the following description, the synchrotron radiation SR will be selectively referred to in describing the behavior of radiation for the simplicity of explanation. Thus, the present invention is not limited to the synchrotron radiation SR.

To effect the perpendicular deflection, the illustrated embodiment has the variable vertically deflecting electromagnet 32*a* disposed between the multipole electromagnetic mechanisms Qd 6 and Qf 5 on the downstream side among other multipole electromagnetic mechanisms 7. The positions at which the variable vertically deflecting electromagnet 32*a* and the variable horizontally deflecting electromagnets 32*b* are disposed are not specifically restricted. It suffices to have these variable deflecting electromagnets 32*a*, 32*b* at suitable positions along the electron orbit.

Figure 8:
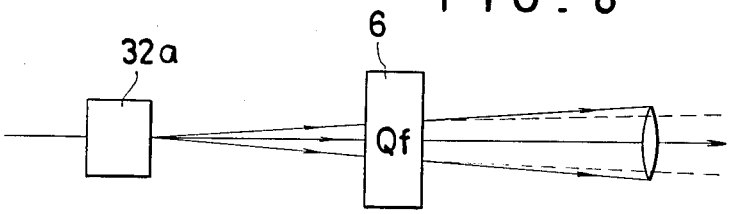
FIG. 8 is an explanatory diagram illustrating the relation between a variable vertically deflecting electromagnet and an electron beam.
Figure 9:
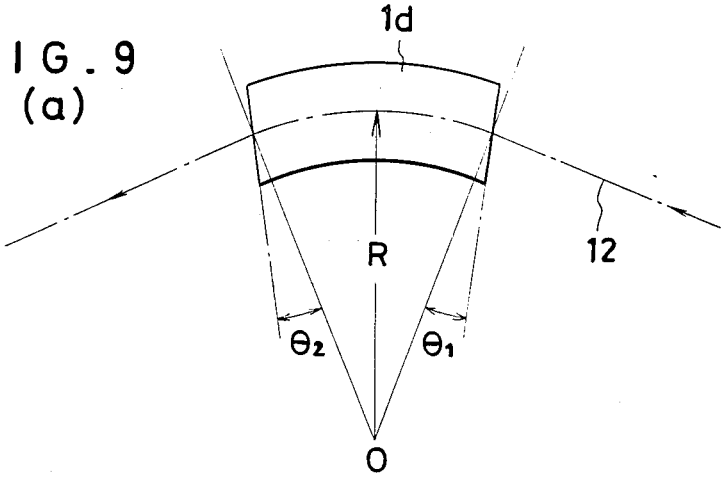
FIG. 9(*a*) is a schematic plan view of a deflecting electromagnet.
Figure 9:
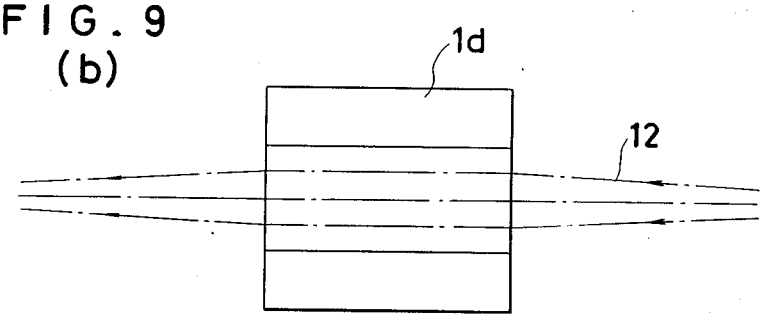
Figure 10:
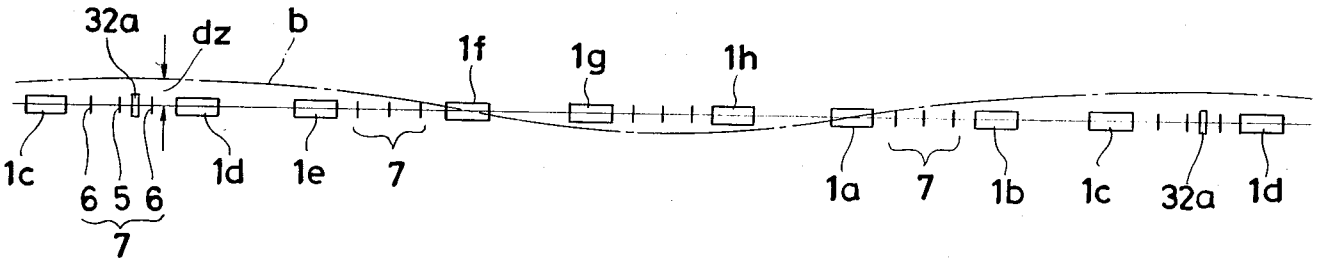
FIG. 10 is a model diagram illustrating the undulation characteristic of the electron beam due to vertical deflection.

The orbit of the electron beam which is caused by the magnetic field of the vertically deflecting electromagnet 32*a* (about some tens of gausses, for example) to impinge upon the Qf 6 on the downstream side as illustrated in FIG. 8 is deflected as amplified in the upward or downward direction by the vertically dispersing force of Qf 6 and, therefore, is caused to impinge upon the deflecting electromagnet 1*d* having a deflecting angle of 45° (FIG. 7). The deflecting electromagnet 1*d* is provided with a tilted incident angle $\theta_1$ (11.7°) as illustrated in FIG. 9(*a*) and has a vertical focusing force as illustrated in FIG. 9(*b*). The electron beam projected as deflected in the upward or downward direction undergoes correction of orbit in the upward or downward direction, passes through the deflecting electromagnet 1*d*, and again undergoes orbit correction as vertically focused by the tilted incident angle $\theta_2$ (11.7°) on the downstream side of the deflecting electromagnet 1*d*. The electron beam which passes through the deflecting electromagnet 1*d* runs substantially horizontally at a distance of dz cm separated vertically from the design orbit as illustrated in FIG. 10 and successively passes through the deflecting electromagnets 1*e*–1*h* on the downstream side similarly as subjected to the vertical focusing force. At this time, the electron beam b which impinges upon the multipole electromagnetic mechanism 7 on the further downstream side intersects the design orbit at Qd 5 of that particular multipole electromagnetic mechanism 7 so that the upwardly deflected beam is bent downwardly and the downwardly deflected beam is bent upwardly to produce a vertical undulation through the deflecting electromagnets 1*a*, 1f as nodes N falling at the third positions respectively as counted in the opposite directions from the variable vertically deflecting electromagnet 32*a* as the substantial center as illustrated in FIG. 10. These nodes occur at two substantially fixed positions relative to the position at which the variable vertically deflecting electromagnet 32*a* is disposed. Thus, they may be allowed to occur at suitable positions along the electron orbit, depending on the use of the radiation and the spatial restrictions.

As described above, the vertically undulating electron beam b can be transformed into desired light by causing the electron beam to impinge upon the wiggler 31.

Now, the stable undulation of the electron beam in the horizontal direction will be described. To effect the horizontal deflection, the variable horizontally deflecting electromagnet 32*b* is disposed at the position of the variable vertically deflecting electromagnet 32*a* or between the downstream pair of Qd 5 and Qf 6 in the multipole electromagnetic mechanism 7 on the downstream side.

Depending on the existent condition of the horizontally deflecting electromagnet (not less than 100 gausses), the orbit of the electron beam b which impinges upon the downstream Qf 6 as indicated by the chain line in FIG. 7 is deflected toward the left (inwardly) or toward the right (outwardly), subjected to orbit correction respectively in the reverse directions by the horizontally focusing force of Qf 6, and then projected horizontally into the deflecting electromagnet 1*d* as separated by a distance of dx cm laterally from the design orbit as shown in FIG. 7. Owing to the tilt incident angle $\theta_1$ (11.7°) of the deflecting electromagnet 1*d*, the aforementioned deflection of dx cm brings about no notable effect on the radius of orbit R in the magnetic field. Consequently, the orbit of the electron beam b is stably undulated outwardly or inwardly in parallel to the design orbit. Similarly to the vertical undulation, nodes N are formed one each at four substantially fixed positions relative to the position at which the variable horizontally deflecting electromagnet 32*b* is placed. Then by the Qf 6 disposed at a further downstream position, the electron beam is further focused in the horizontal direction.

The deflected orbit of the beam b indicated by the chain line in FIG. 7 is depicted in an exaggerated manner with a model. The electron beam which passes through the wiggler 31 runs substantially in parallel with the design orbit at a distance of dx cm separated horizontally from the design orbit.

Figure 12:
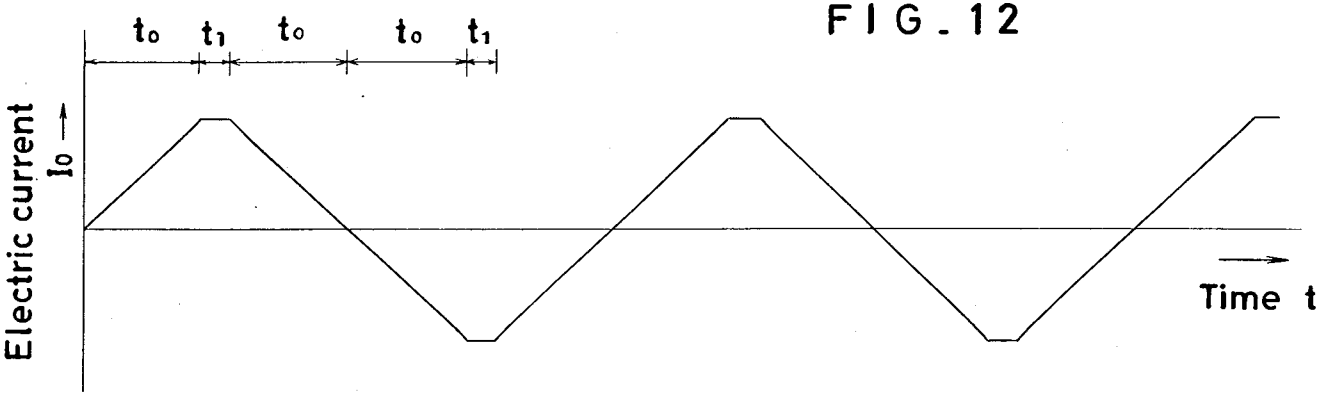
FIG. 12 is a diagram of a typical waveform of a magnetizing current.
Figure 11:
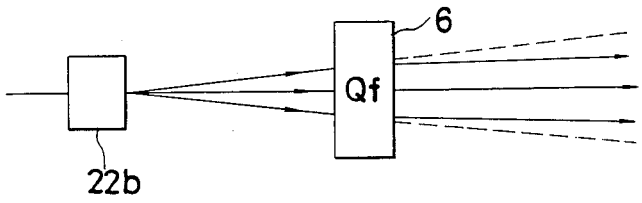
FIG. 11 is an explanatory diagram illustrating the relation between a variable horizontally deflecting electromagnet and an electron beam.

Now, the parallel control of the electron beam will be described below with reference to the magnetizing current waveform diagram shown in FIG. 12.

In the diagram, the horizontal axis is the scale of time t and the vertical axis the scale of magnetizing current Io. A desired variable magnetizing current Io is applied between a time interval of $t_0$ and $t_1$ to the variable vertically deflecting electromagnet 32*a* and the variable horizontally deflecting electromagnet 32*b*.

The electron beam is displaced at a fixed velocity for a period of t*0* seconds by distances of dz cm and dx cm relative to the Z axis and the X axis. After $t_1$ seconds' stop, it is again displaced at a fixed velocity for a period of $t_0$ seconds to distances of dz cm and dx cm. After $t_1$ seconds' stop, the magnetizing current Io is controlled so that the electron beam will be returned to its original position.

Now, the construction and operation of the wiggler 31 from which the wiggler radiation can be emitted by introducing the incident electron beam thereto will be described.

Figure 13A:
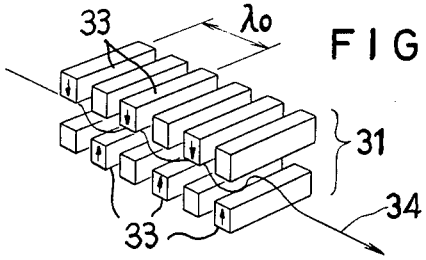
FIG. 13(*a*) is a schematic diagram of a wiggler.
Figure 13B:
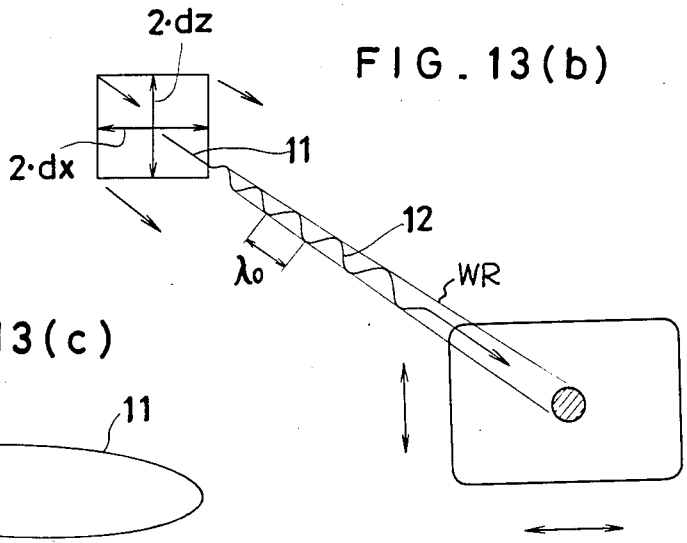
Figure 13C:
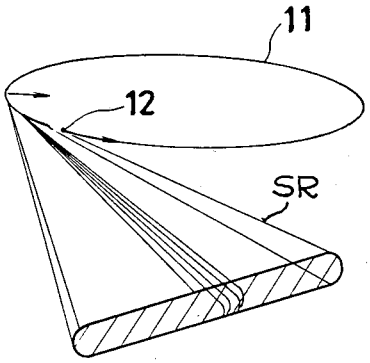

FIG. 13(*a*) represents a schematic diagram of the wiggler 31. In this diagram, small permanent magnets 33 of opposite polarity are alternately disposed in two horizontal rows. By 34 is denoted an electron beam and by $\lambda_0$ the length of a cycle.

The wiggler radiation WR emitted from the wiggler 31 is a pencil-like radiation possessing high brightness and a meta-monochrome $10^2$ to $10^3$ times as high, as compared with the synchrotron radiation SR from the conventional storage ring. The directivity from the SR is exclusively in the direction perpendicular to the plane of electron orbit as illustrated in FIG. 13 (*c*). The SR is a diverging light source the light of which diverges in directions tangential to the circular orbit in the plane of the orbit. In contrast, the WR from the wiggler 31 is a pencil-like radiation possessing linear directivity such that the electrons are radiated in a zigzagging pattern as illustrated in FIG. 13(*b*). By deflecting from the design orbit the undulated electrons passing through the wiggler 31 by 2 dz cm in the vertical direction and by 2 dx cm in the horizontal direction as shown in FIG. 13(*b*), the powerful wiggler radiation WR can be irradiated to a large area of a given substrate. The ratio of relative brightness between the WR and the SR is as follows.

$$2n < [WR]/[SR] < 4n^2$$

In the formula, n stands for the number of cycles of the wiggler 31. Here, the minimum value of the ratio of relative brightness equals the number of antinodes in the zigzagging electron orbit and the maximum of the ratio equals the value which exists when the radiations emitted coherently at the antinodes at which electron beams advance in one and the same direction. Where the wiggler 31 is formed of permanent magnets made of such magnetic substance as $SmCO_5$, for example, the length of cycle, $\lambda_0$, is about 3 to 4 cm. When the number of cycle n is assumed in this case to be 10, then the WR acquires brightness 400 times as high as the SR. When the number of cycle n is assumed to be 16, then the WR acquires brightness 1000 times as high as the SR. Thus, a part of the energy of the electron beam passing through the wiggler 31 is transformed into radiation of greatly increased brightness. Because of the particular structure of the electron undulating ring, the wiggler 31 is disposed in the linear portion excluding the positions of the part for admitting the incident electrons and the high-frequency cavity.

Figure 14:
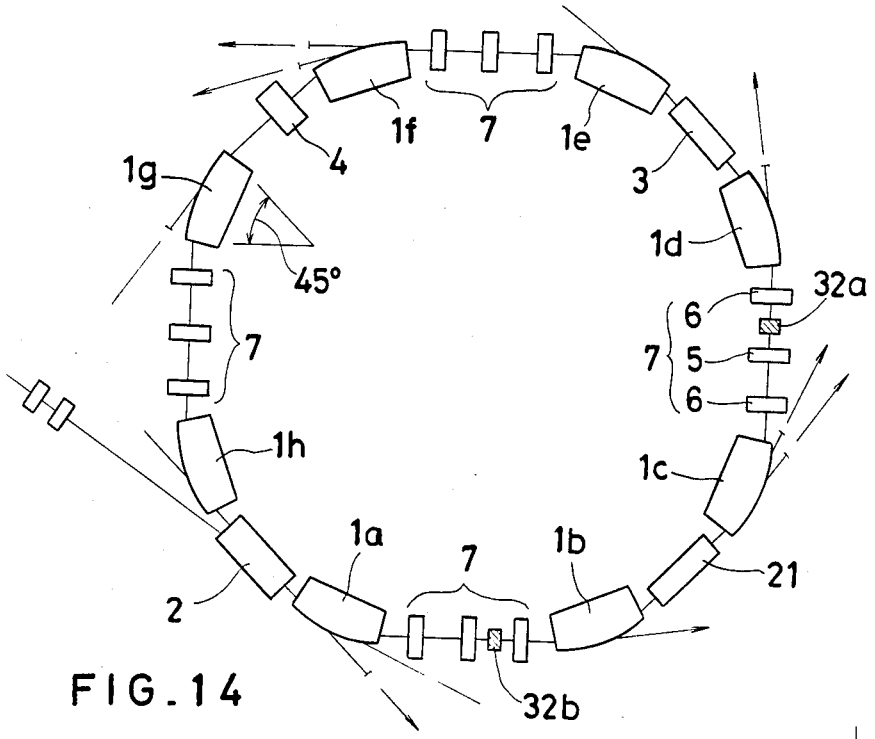
FIG. 14 is a schematic structural diagram of another typical X-ray generating apparatus embodying the present invention.

FIG. 14 is a schematic structural diagram of an electron undulating ring as another embodiment of this invention. In this embodiment, the variable vertically deflecting electromagnet 32*a* and the variable horizontally deflecting electromagnet 32*b* are incorporated in two different multipole electromagnetic mechanisms 7. Similarly to the preceding embodiment, the present embodiment is capable of obtaining an intensifier radiation source having a wider tilt angle than the conventional synchrotron radiation. It is further capable of stably moving electron along the orbit at a fixed velocity in the perpendicular and horizontal directions.

Comparison of the present embodiment with the embodiment of FIG. 7 clearly reveals that the variable vertically deflecting electromagnet 32*a* and the variable horizontally deflecting electromagnet 32*b* which are essential components for the construction of this invention are equally effective no matter where they may be disposed along the electron orbit in spite of various restrictions such as the construction of the multipole electromagnetic mechanisms.

Figure 15:
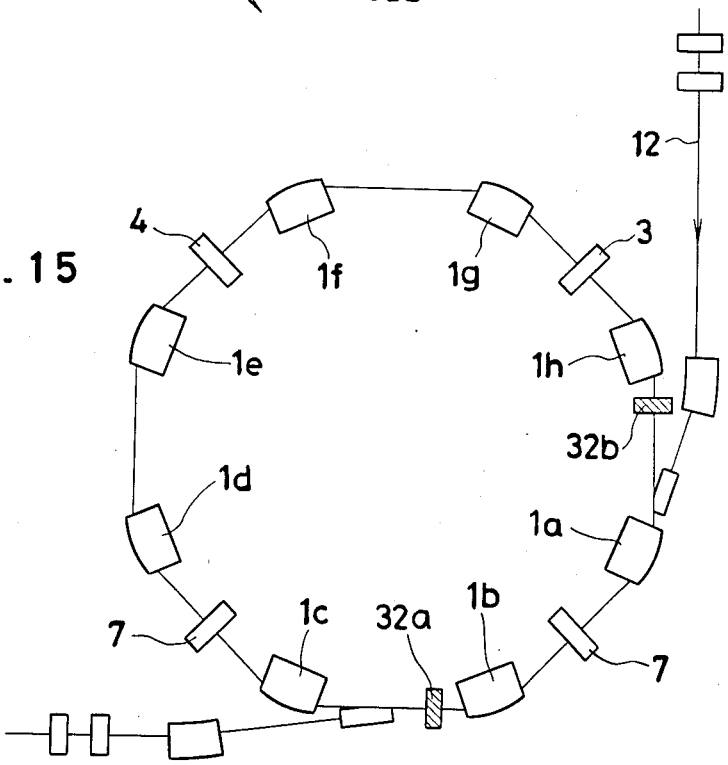
FIG. 15 is a schematic structural diagram of yet another typical X-ray generating apparatus embodying the present invention.

Further, the present invention can be applied similarly advantageously to the multipole electromagnetic mechanism of a singlet structure as schematically illustrated in FIG. 15. In this embodiment, the multipole electromagnetic mechanisms 7 are disposed between the deflecting magnets (1*b*–1*c* and 1*h*–1*a*).

In any of the em-bodiments described above, a total of eight deflecting electromagnets 7 are disposed so as to effect deflection by 45°. This invention has no reason to limit the number of deflecting electromagnets to be incorporated. Optionally, there may be used a total of six deflecting electromagnets adapted to effect deflection by 60°. This invention places no restriction on the scale or form of the electron undulating ring.

What is claimed is:

1. An X-ray generating apparatus, comprising: a source of electrons a plurality of deflecting electromagnets disposed along an electron orbit;

at least one high-frequency cavity disposed between pair of adjacent deflecting electromagnets and adapted to accelerate electrons;

a multipole electromagnetic mechanism formed of at least one multipole electromagnet disposed between a pair of adjacent deflecting electromagnets and focusing electrons in the horizontal direction and/or the vertical direction; and at least one deflecting means disposed between a pair of adjacent deflecting electromagnets and undulating the orbit of electrons around a design orbit.

2. An X-ray generating apparatus according to claim 1, wherein said deflecting means comprises a variable magnitude vertically deflecting electromagnet to deflect electrons on the orbit in the vertical direction.

3. An X-ray generating apparatus according to claim 1, wherein said deflecting means comprises a variable magnitude horizontally deflecting electromagnet to deflect electrons on the orbit in the horizontal direction.

4. An X-ray generating apparatus according to claim 1, wherein said deflecting means comprises a variable magnitude vertically deflecting electromagnet to deflect electrons on the orbit in the vertical direction and a variable magnitude horizontally deflecting electromagnet to deflect said electrons in the horizontal direction.

5. An X-ray generating apparatus according to claim 4, wherein said variable magnitude vertically deflecting electromagnet and said variable magnitude horizontally deflecting electromagnet are disposed both between one and the same pair of adjacent deflecting electromagnets.

6. An X-ray generating apparatus according to claim 4, wherein said variable magnitude vertically deflecting electromagnet and said variable magnitude horizontally deflecting electromagnet are disposed one each between two different pairs of adjacent deflecting electromagnets.

7. An X-ray generating apparatus according to claim 1, wherein a wiggler transforms electron energy into X-rays is disposed between a pair of adjacent deflecting electromagnets other than the pairs of adjacent deflecting electromagnets having said high-frequency cavity and said multipole electromagnetic mechanism interposed therebetween.

8. An X-ray generating apparatus according to claim 1, wherein each of said multipole electromagnetic mechanisms forms a triplet with one perpendicularly focusing electromagnet and a pair of horizontally focusing electromagnets disposed on opposite sides thereof and at least one of said deflecting means is disposed between said perpendicularly focusing electromagnet and said horizontally focusing electromagnet disposed on a further downstream side.

9. An X-ray generating apparatus according to claim 1, wherein each of said multipole electromagnetic mechanisms forms a doublet with one perpendicularly focusing electromagnet and one horizontally focusing electromagnet and at least one of said deflecting means is disposed between said perpendicularly and horizontally focusing electromagnets.

10. An X-ray generating apparatus according to claim 1, wherein each of said multipole electromagnetic mechanisms forms a singlet of one focusing electromagnet.

* * * * *